US008037560B2

(12) United States Patent
Goldner

(10) Patent No.: US 8,037,560 B2
(45) Date of Patent: Oct. 18, 2011

(54) PORTABLE, INFLATABLE CUSHION

(76) Inventor: Gal Goldner, Kibbutz Tel-Yosef 1 (IL)

( * ) Notice: Subject to any disclaimer, the term of this patent is extended or adjusted under 35 U.S.C. 154(b) by 80 days.

(21) Appl. No.: 12/279,421

(22) PCT Filed: Feb. 22, 2007

(86) PCT No.: PCT/IL2007/000241

§ 371 (c)(1),
(2), (4) Date: Aug. 14, 2008

(87) PCT Pub. No.: WO2007/096881

PCT Pub. Date: Aug. 30, 2007

(65) Prior Publication Data

US 2010/0199424 A1 Aug. 12, 2010

Related U.S. Application Data

(60) Provisional application No. 60/775,795, filed on Feb. 23, 2006.

(51) Int. Cl.
*A47C 27/10* (2006.01)

(52) U.S. Cl. ..... 5/654; 5/655.3; 5/713; 297/DIG. 10; 297/DIG. 8

(58) Field of Classification Search ..... 5/710–713, 5/715, 615, 653, 654, 655.3; 297/DIG. 3, 297/DIG. 8, DIG. 10

See application file for complete search history.

(56) References Cited

U.S. PATENT DOCUMENTS 4,905,329 A * 3/1990 Heilner ..... 5/654
5,505,518 A * 4/1996 Pike ..... 297/242
5,619,764 A * 4/1997 Lopau ..... 5/713
5,742,957 A * 4/1998 Vanzant ..... 5/81.1 R
5,988,747 A * 11/1999 Jeans ..... 297/313
6,317,909 B1 * 11/2001 Blum ..... 5/654

* cited by examiner

*Primary Examiner* — Michael Trettel
(74) *Attorney, Agent, or Firm* — Mark M. Friedman

(57) ABSTRACT

Presented herein is a portable cushion that is divided into multiple inner cells, said structure comprising a base layer, at least two columns of at least two inflatable cells each disposed on said base layer, a lightweight, portable air pressure generator for supplying air to the cushion, and a hose to connect said cushion to said air pressure generator, wherein the inflating sequence of the cushion enables one layer of cells to fully inflate before the subsequent layer of cells is able to inflate.

12 Claims, 8 Drawing Sheets

PORTABLE, INFLATABLE CUSHION

FIELD OF INVENTION

This invention relates generally to personal lifting devices, and specifically to such devices that lift the user by means of a portable, inflating cushion.

BACKGROUND OF THE INVENTION

Rising from a seated position and seating oneself are actions that require specific motor skills, stability, and a certain amount of muscle strength.

For people who do not possess these abilities and strengths, such as elderly persons, people with specific physical impairments, and people recovering from some surgeries, the seemingly simple task of getting out of a chair may be impossible without some assistance.

Available related art inflatable cushions, which provide support for rising from a chair, attempt to provide solutions to this problem. Illustrative of such attempts are U.S. Pat. No. 6,015,471, U.S. Pat. No. 4,905,329, U.S. Pat. No. 5,742,957, GB2287878, and GB229641, which each provides inflatable cushions for lifting assistance. However, such devices are not portable, they do not provide extra stability, and oftentimes these aids rely on the arm supports of a chair to stabilize the user.

The available aids are unstable, particularly on chairs that do not incorporate armrests and, furthermore, the available related art devices are rarely portable. There is a clear need for a portable device that lifts the user from a seated to a substantially standing position, which furthermore enables the user to stand of his own impetus, without additional support. Such a device should further provide the user with a stable seating area while said device is in use.

None of the above inventions and patents, taken either singularly or in combination, is seen to disclose such a device as will subsequently be described and claimed in the instant invention.

SUMMARY OF THE INVENTION

Presented herein is a novel cushion device that may be disposed on the seat of a chair to lift a person from the seated position to a substantially standing position.

The present invention comprises a single cushion divided into multiple inner cells that may be inflated sequentially and a portable air pressure generator.

The device of the present invention further allows the user to remain comfortably seated throughout the entire lifting process, and moreover lets the user remain seated even after the lifting process is complete.

A novel feature of the present invention is an inflation sequence that allows each cell of each layer to inflate separately, thereby providing additional stability and substantial lateral support.

A key feature of the present invention is that the added stability and lateral support makes it possible to use the present invention on any type of chair. The present invention enables a user to exit a chair without additional assistance in the form of another person, the arms of a chair, or other types of support.

An added benefit of the present invention is that it is applicable for use with various specialized furniture. Use of the present invention will not interfere with the ergonomic features of specially designed chairs such as, for example, office chairs, and is altogether suitable for use with wheelchairs.

Furthermore, a user may remain comfortably seated on the cushion of the present invention in its deflated state, for long periods of time, because the present invention is quite compact and flat when deflated.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings, wherein.

Figure 1:
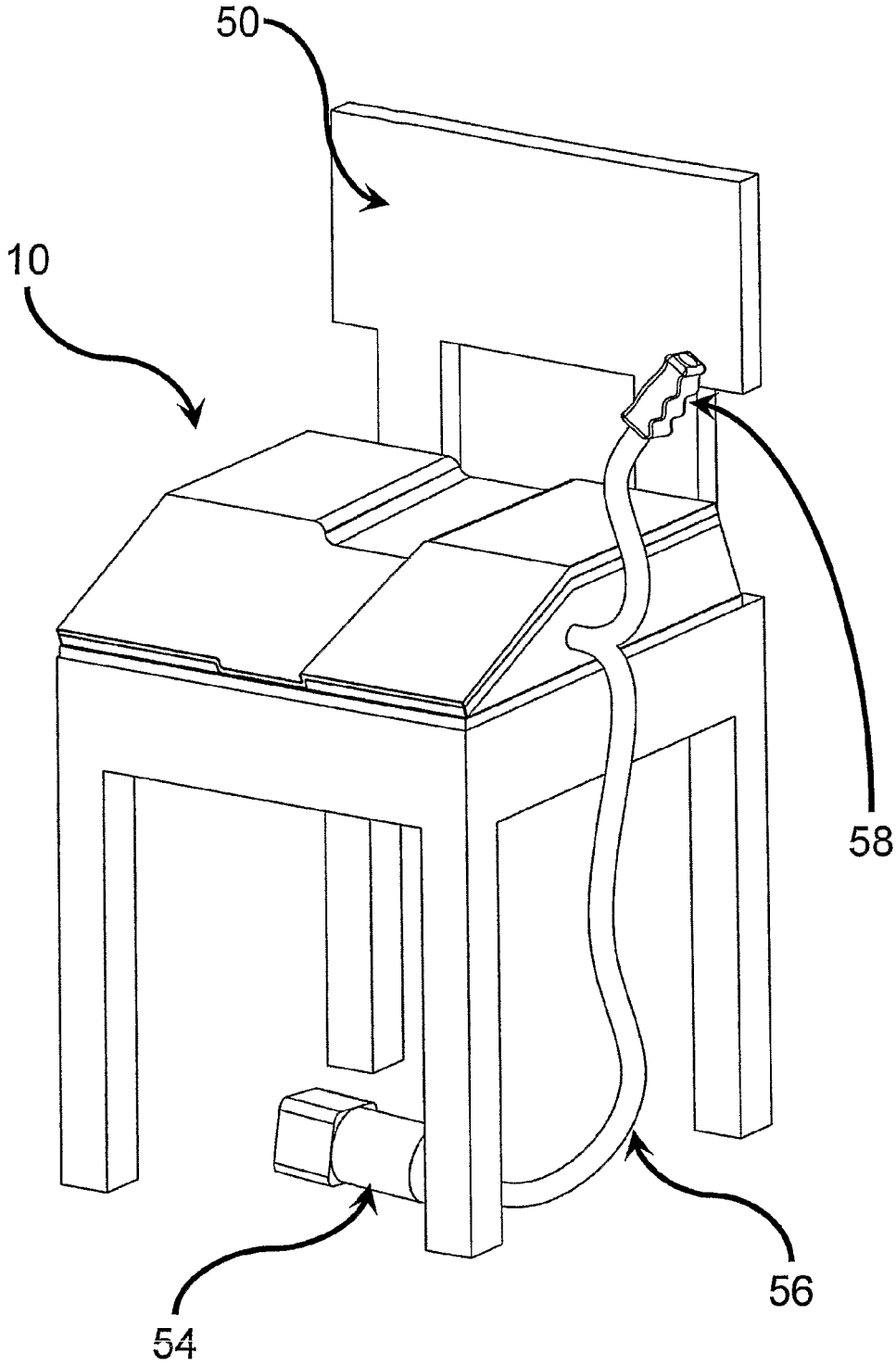
FIG. 1 is a perspective view of an embodiment of the present invention, partially inflated and disposed on the seat of a chair.

The drawings together with the description make apparent to those skilled in the art how the invention may be embodied in practice.

No attempt is made to show structural details of the invention in more detail than is necessary for a fundamental understanding of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF EMBODIMENTS OF THE INVENTION

Referring now in detail to the drawings, a cushion 10 of the present invention comprises a plurality of precisely configured inflatable cells that may be inflated sequentially such that the resulting inflated cushion 10 not only provides the user with assistance in rising from a seated position, but also supports the user while sitting and rising. This support allows the user to rise from and sit in any type of seat, and cushion 10 is not limited to use with, for example, a chair equipped with arms. Furthermore, the present invention provides a comfortable, stable seating surface 52 both during the inflation process and after cushion 10 is fully inflated. This feature enables cushion 10 to provide excellent stability to the user during the lifting process. Furthermore, the user is not forced to vacate the chair 50 once cushion 10 is fully inflated.

Embodiments of the present invention further comprise a portable air pressure generator 54 that may be used to inflate cushion 10. Air pressure generator 54 may be operatively connected to cushion 10 by a hose 56.

According to embodiments of the present invention, the entire device is quite portable. Cushion 10 may be folded into a size and shape that is easily transported by hand, and, according to some embodiments, both cushion 10 and air pressure generator 54 may fit into a single portable carrying container such as, for example, a tote bag.

An embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions.

It is understood that the phraseology and terminology employed herein is not to be construed as limiting and is for descriptive purpose only.

The principles and uses of the teachings of the present invention may be better understood with reference to the accompanying description, figures, and examples.

It is to be understood that the details set forth herein do not construe a limitation to an application of the invention. Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, integers or groups thereof and that the terms are not to be construed as specifying components, features, steps or integers.

The phrase "consisting essentially of", and grammatical variants thereof, when used herein is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element.

It is to be understood that where the claims or specification refer to "a" or "an" element, such reference is not to be construed as there being only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" refers to manners, means, techniques and procedures for accomplishing a given task including, but is not limited to those manners, means, techniques and procedures either known to, or readily developed from known manners, means, techniques and procedures by practitioners of the art to which the invention belongs.

The descriptions, examples, methods, and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

The terms "bottom", "below", "top" and "above" as used herein do not necessarily indicate that a "bottom" component is below a "top" component, or that a component that is "below" is indeed "below" another component or that a component that is "above" is indeed "above" another component. As such, directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

According to embodiments, cushion 10 includes a base layer 16 with at least one left outer column 17 and at least one right outer column 20 disposed over base layer 16, wherein left outer column 17 and right outer column 20 are each divided into cells arranged into at least one lowermost layer of cells 22 and at least one uppermost layer of cells 26.

According to embodiments of the present invention, base layer 16 provides the foundation of cushion 10. Base layer 16 comprises a single, inflatable cell and defines the size and shape of the bottom of cushion 10. According to some embodiments of the present invention, base layer 16 is substantially rectangle-shaped with rounded corners. According to some other embodiments, base layer 16 may conform to the shape of a specific chair 50. In yet other embodiments, base layer 16 of the present invention may be constructed in other shapes without departing from the scope of the invention. For example, base layer 16 may be substantially square, oval, or triangular in shape.

Base layer 16 functions as the air inlet for the remainder of the cells that comprise cushion 10 of the present invention, enabling incoming air to be evenly dispersed into lowermost layer of cells 22.

Base layer 16 of the present invention essentially replaces the inlet air distribution hoses seen in related art that sit under a chair, thereby effectively eliminating the uncomfortable, uneven seating surfaces often found in the related art.

According to embodiments of the present invention, the remainder of the cells that comprise cushion 10 are arranged in at least two columns, each column comprising at least two cells.

According to some embodiments of the present invention, there are an equal number of cells in each column 17, 18, and 20. According to some other embodiments, each of left outer column 17, inner columns 18, and right outer column 20 may have different numbers of cells.

Figure 2:
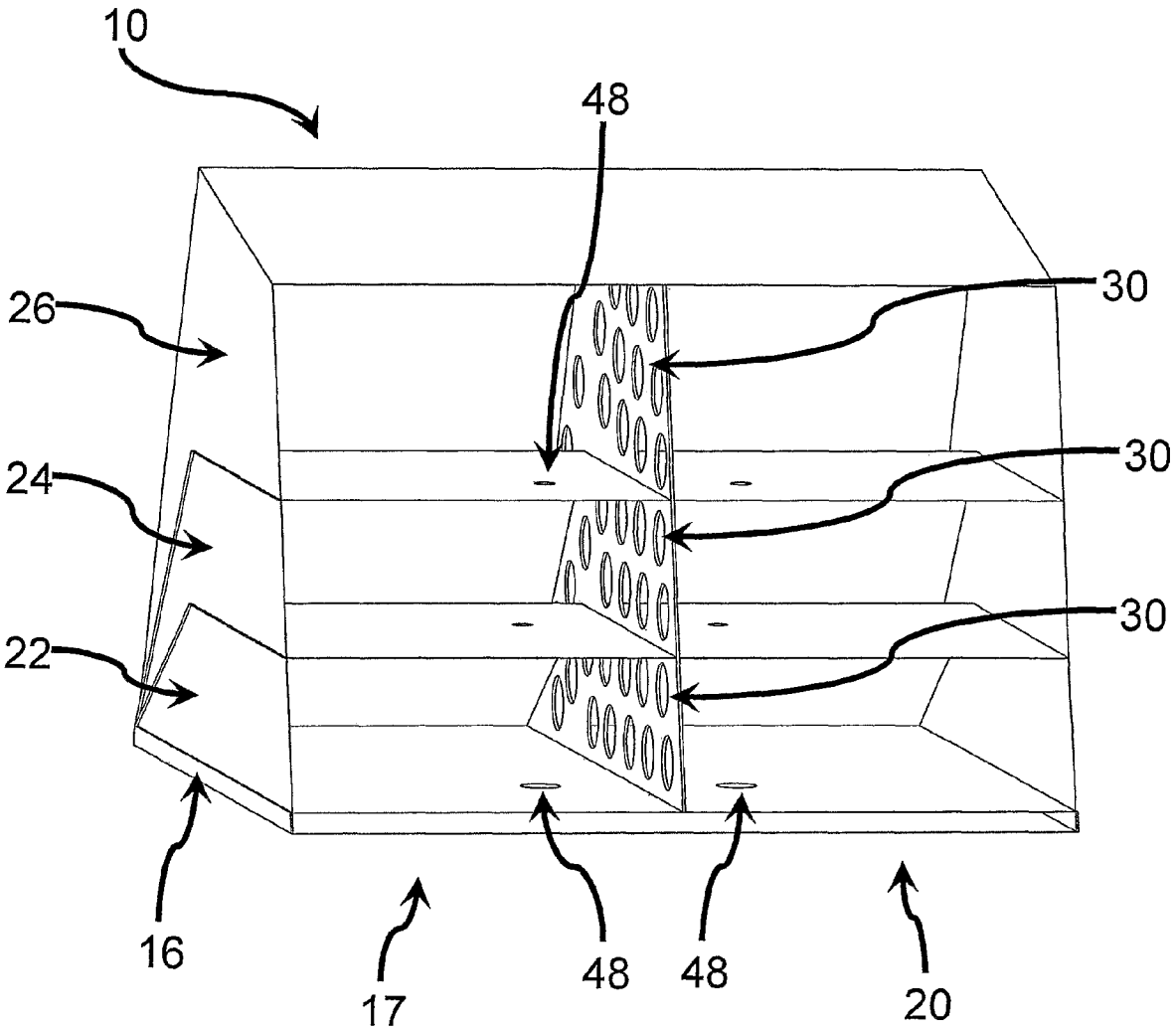
FIG. 2 is a rear sectional view of an embodiment of the present invention, fully inflated, wherein the cells are configured into two columns of three cells each.
Figure 7:
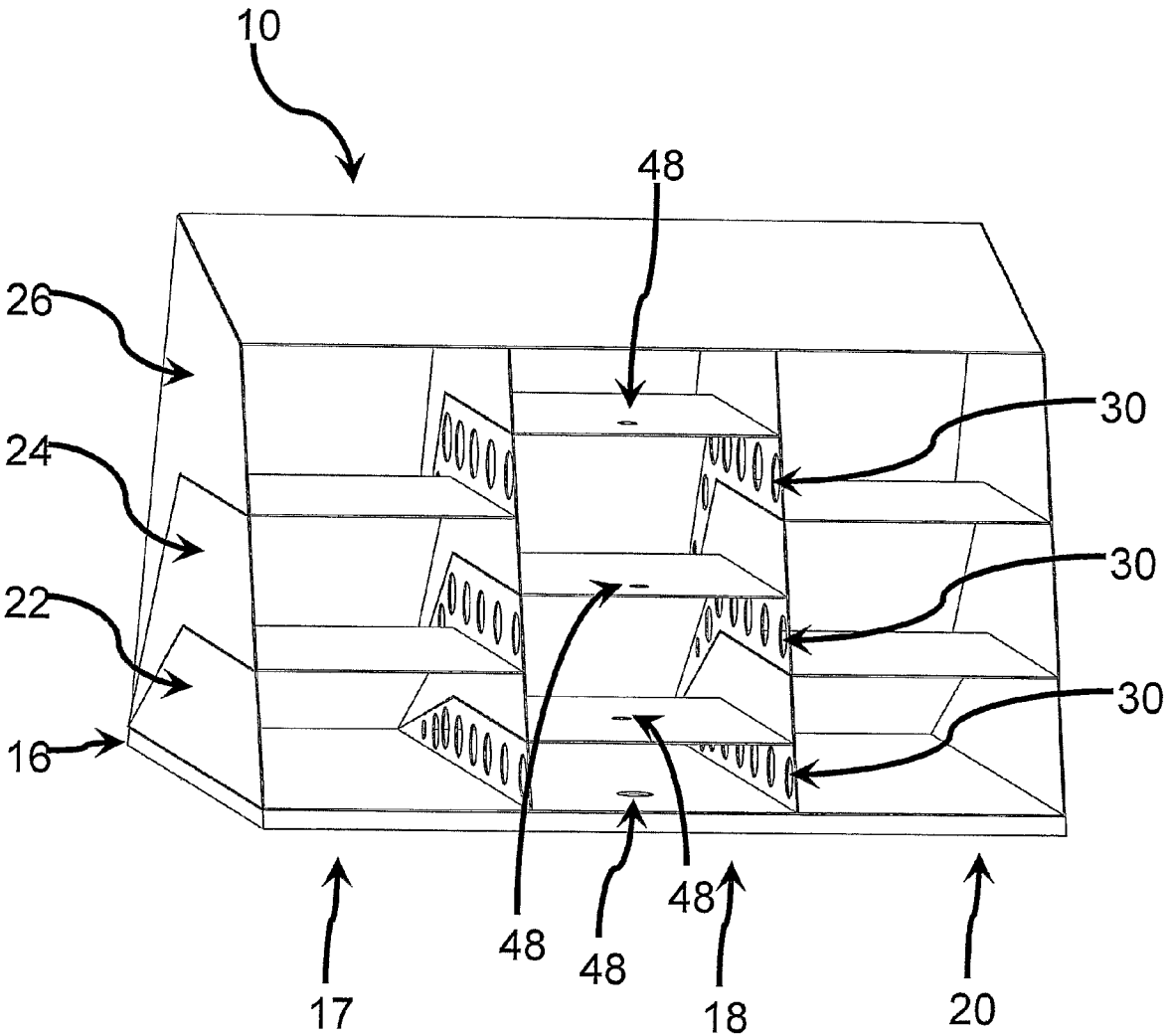
FIG. 7 is a rear sectional view of the embodiment of FIG. 3, wherein all of the cells are inflated.

FIG. 2 shows an embodiment of the present invention that has a left outer column 17 comprising three cells and a right outer column 20 also comprising three cells. FIG. 7 shows another embodiment of the present invention wherein left outer column 17 and right outer column 20 of cushion 10 each comprise three cells and an inner column 18 comprises four cells. Such a configuration may enable greater lateral stability of left outer column 17 and right outer column 20. It is understood that other configurations of columns and cells may also be used without departing from the scope of the invention.

Disposed on base layer 16 is a lowermost layer of cells 22, comprising the lowermost cells of each column 17, 18, and 20.

As discussed above, lowermost layer of cells 22 may all be on the same level, or alternatively, lowermost layer of cells 22 of one or more inner columns 18 may be lower than lowermost layer of cells 22 of left outer column 17 and right outer column 20, enabling greater lateral stability of left outer column 17 and right outer column 20.

Arranged over each lowermost layer of cells 22, there may be at least one intermediate layer of cells 24. Each subsequent intermediate layer of cells 24 may be arranged in the same fashion across the preceding intermediate layer of cells 24.

According to some embodiments of the present invention, all of the cells of intermediate layers of cells 24 may be of the same height, as seen in FIG. 2. According to other embodiments, there may be a different number of intermediate layers of cells 24 in, for example, at least one inner column 18. It is understood that other configurations of intermediate layers of cells 24 may be used without departing from the scope of the invention.

It should also be understood that an intermediate layer of cells 24 is not necessary to cushion 10 of the present invention, and intermediate layers of cells 24 may be an optional feature.

According to embodiments of the present invention, an uppermost layer of cells 26 comprises the top cells of each of left outer column 17, inner columns 18, and right outer column 20.

Figure 8:
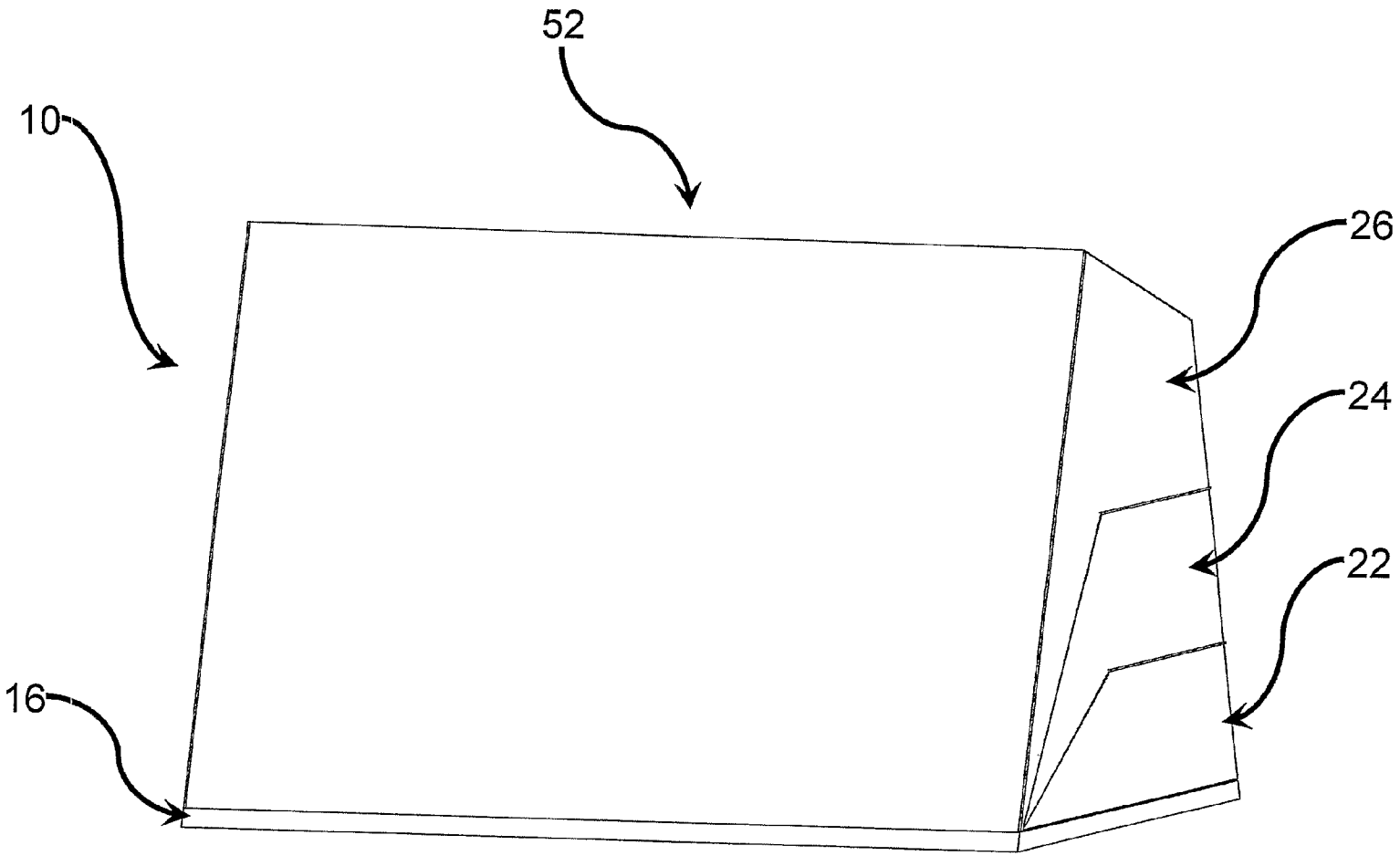
FIG. 8 is a front perspective view of the embodiment of FIG. 3, wherein all of the cells are inflated.

A novel feature of the present invention is that uppermost layer of cells 26 is configured to provide a substantially planar top surface to cushion 10. Throughout the inflation process, the top surface of cushion 10 provides a comfortable and natural seating surface 52 for the user. This feature further serves to increase the stability of the seated user. The stability may be further enhanced by providing seating surface 52 with, for example, a slight backward tilt; as can be seen in FIGS. 7 and 8. Such an enhancement also provides the user with a greater sense of security while seated that he may remain in the seat and will not be ejected from or spill off cushion 10.

According to embodiments of the present invention, air pressure generator 54 of cushion 10 provides the air supply and air pressure, as needed, to the cells of cushion 10. Although light-weight and portable, air pressure generator 54 is also powerful enough to generate adequate air pressure to inflate cushion 10 while an adult is seated on cushion 10. It should be understood that other methods may also be used for inflating cushion 10.

According to some embodiments of the present invention, air pressure generator 54 may be powered by rechargeable batteries. Alternatively, air pressure generator 54 may be powered by, for example, plugging air pressure generator 54 into an electric outlet or by means of solar power.

According to embodiments of the present invention, a flexible hose 56 may operatively connect air pressure generator 54 to base layer 16 of cushion 10, providing a path for the air to travel from air pressure generator 54 into base layer 16.

According to embodiments of the present invention, a control mechanism 58, such as the control handle seen in FIG. 1, is operatively connected to air pressure generator 54. Control mechanism 58 may be positioned, for example, on or near cushion 10. Control mechanism 58 may activate air pressure generator 54 in order to inflate and, according to some embodiments, deflate cushion 10. In some embodiments of the present invention, control mechanism 58 is connected to air pressure generator 54 by means of a cable or wire; in other embodiments, control mechanism 58 may be wirelessly connected to air pressure generator 54. According to some embodiments of the present invention, control mechanism 58 may be used to deactivate air pressure generator 54. According to some other embodiments, air pressure generator 54 may deactivate automatically by means of, for example, a sensor that senses when cushion 10 is adequately inflated. It is understood that other methods may also be used to control air pressure generator 54 without departing from the scope of the invention.

According to some embodiments of the present invention, cushion 10 may be further equipped with a deflate valve that provides an air escape passage for the inflated cushion 10. The deflate valve may be any type of one-way valve that will allow the air to exit cushion 10. The deflate valve may also act as an overflow valve, allowing air to escape as needed to prevent over-inflation. According to some embodiments, such a deflate valve may be operated by control mechanism 58 to deflate cushion 10.

A unique feature to the present invention is the arrangement of a plurality of horizontal air holes 48 and vertical air holes 30 that are dispersed across the inner surfaces of the inflatable cells, as seen in FIGS. 2, 3, 5, and 7. According to embodiments of the present invention, horizontal air holes 48 and vertical air holes 30 may be, for example, apertures that are sealed when compressed and that allow the passage of air between cells when unsealed.

At least one horizontal air hole 48 is positioned on the floor of each one cell of at least one of columns 17, 18, and 20, allowing the air to flow up into the cell above. According to some embodiments of the present invention, at least one horizontal air hole 48 may be further equipped with a valve controlled by air pressure in order to provide additional inflation control.

According to some embodiments of the present invention, one or more vertical air holes 30 may be positioned on the interior, vertical walls of each cell, and allow the air to flow across and over to the neighboring cells. According to some embodiments of the present invention, at least one vertical air holes 30 may be further equipped with a valve controlled by air pressure in order to provide additional inflation control.

Vertical air holes 30 and horizontal air holes 48 are spaced and sized such that the flow of air is precisely controlled throughout the entire cushion 10, regardless of the weight placed on cushion 10.

It is understood, however, that other methods may also be used to control the air flow between the cells that comprise the present invention without departing from the scope of the invention.

A key feature of the present invention is the sequential inflation of the cells of cushion 10, from the lower cells to the upper cells, that is enabled by the path that the incoming air follows when cushion 10 is being inflated.

As one layer of cells becomes fully inflated, horizontal air holes 48 between the inflated layer and the layer above are able to unseal. The unsealed horizontal air holes 48 allow air to flow into the cells of the subsequent layer, and enabling the sequential inflation to continue upwardly. Vertical air holes 30 disposed between the cells allow air to flow across into neighboring cells. The size and distribution of horizontal air holes 48 together with vertical air holes 30 control the inflation rate of each cell within each layer.

This unique sequential inflation configuration ensures the steady, even lifting of the user while also providing stability during the lifting process.

In order to better understand the sequential inflation of cushion 10, further reference is now made to FIGS. 3-8. Air flows from air pressure generator 54 into base layer 16, which inflates first before allowing air to flow across and into the inflatable cells of cushion 10 at a steady rate. Once there is sufficient air pressure in base layer 16, horizontal air holes 48 will unseal and air will begin to flow up through horizontal air holes 48 into lowermost layer of cells 22 of, for example, inner columns 18.

Figure 3:
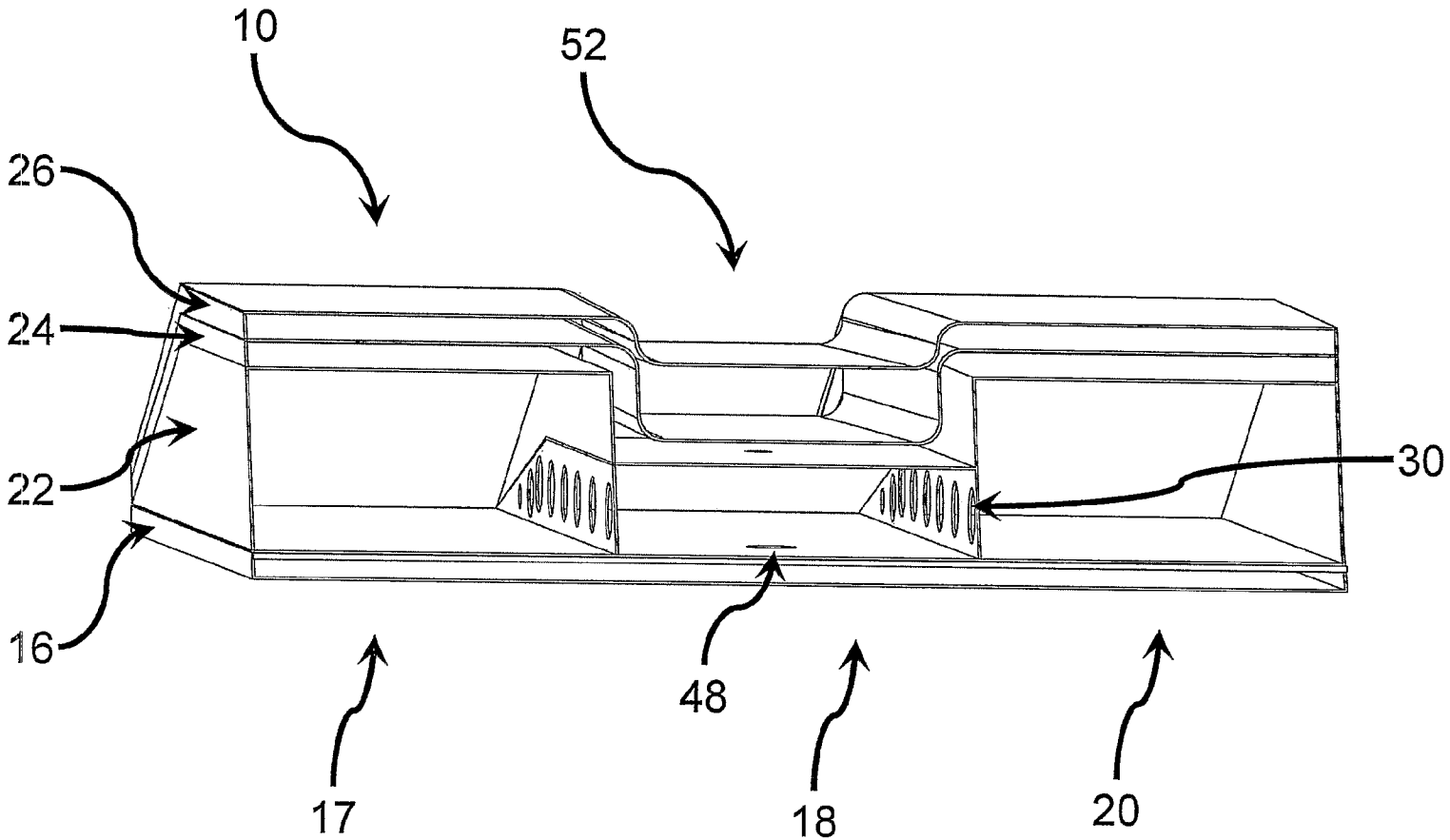
FIG. 3 is a rear sectional view of another embodiment of the present invention, wherein the cells are configured into three columns of three cells each, and the first layer of cells is inflated.
Figure 4:
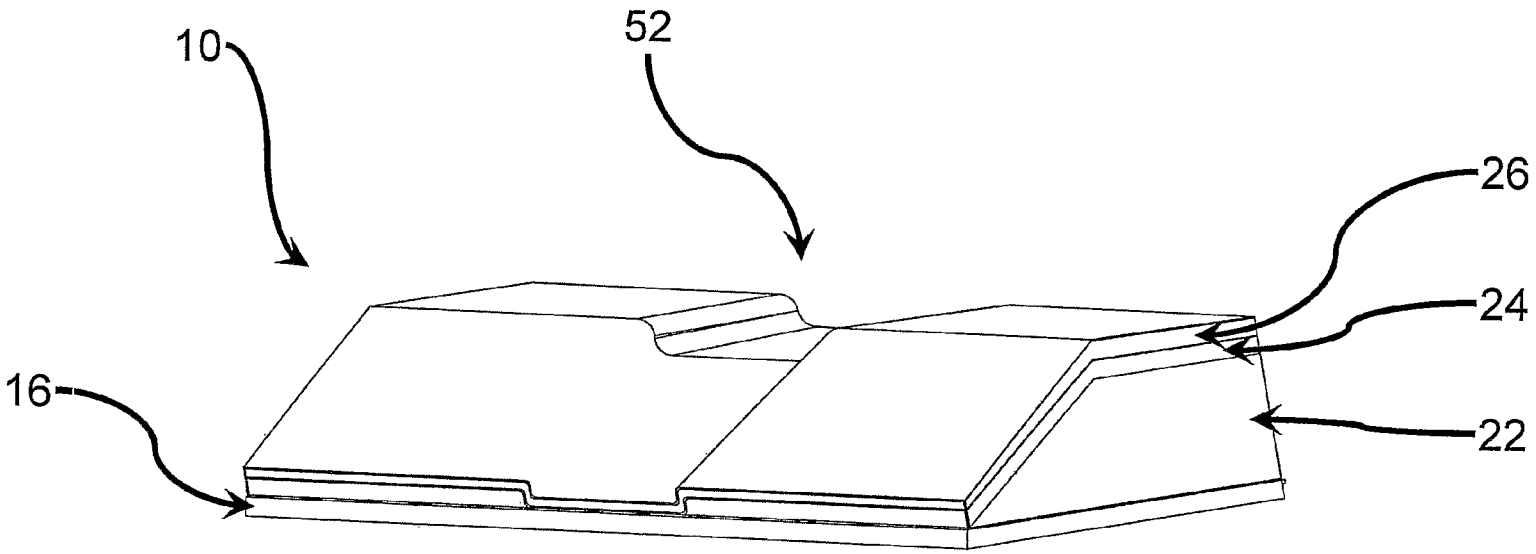
FIG. 4 is a front perspective view of the embodiment of FIG. 3, wherein the first layer of cells is inflated.

As lowermost layer of cells 22 starts to inflate, the lifting process begins and vertical air holes 30 may unseal and allow air to travel laterally through vertical air holes 30 into the lowermost layer of cells 22 of left outer column 17 and right outer columns 20. Note that, according to some embodiments, the cells of lowermost layer of cells 22 of inner columns 18 may not be as tall as the cells of lowermost layer of cells 22 of left outer column 17 and right outer columns 20. Once these cells are also fully inflated, lowermost layer of cells 22 is fully inflated, as seen in FIGS. 3 and 4.

Figure 5:
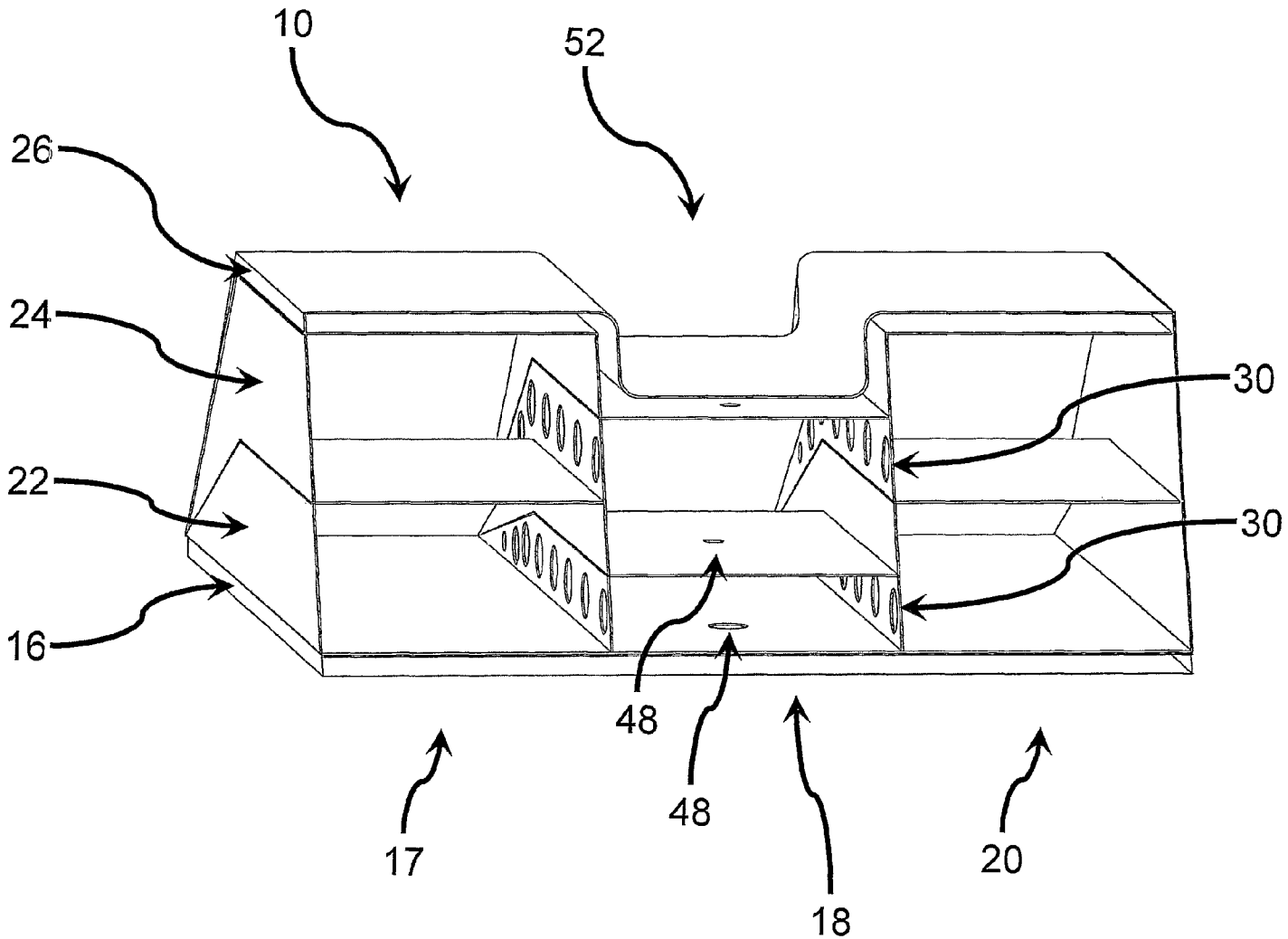
FIG. 5 is a rear sectional view of the embodiment of FIG. 3, wherein the first and second layer of cells is inflated.
Figure 6:
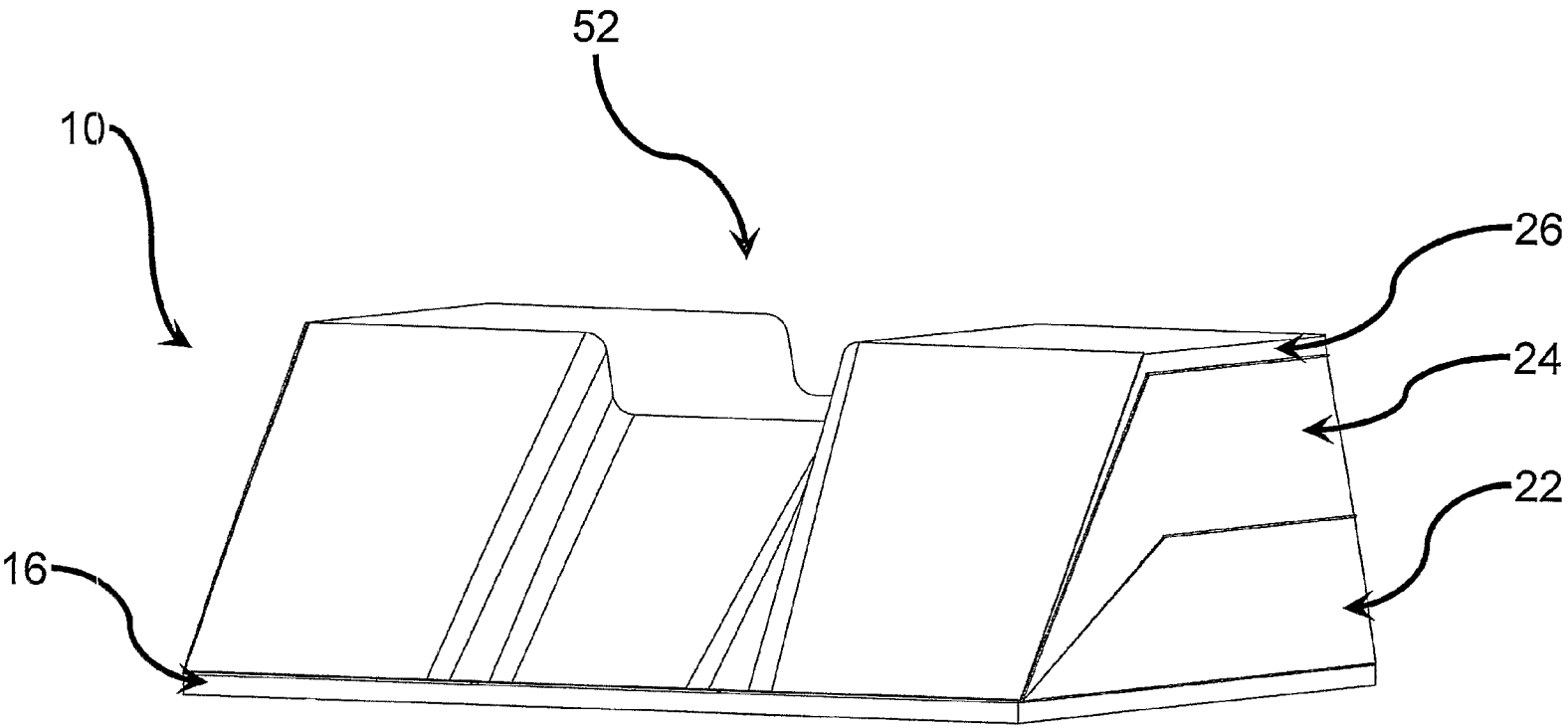
FIG. 6 is a front perspective view of the embodiment of FIG. 3, wherein the first and second layer of cells is inflated.

FIGS. 5 and 6 describe the inflation of intermediate layers of cells 24. According to embodiments, air passes through from lowermost layer of cells 22 into intermediate layer of cells 24 of inner columns 18. As these cells begin to inflate, the air flows laterally into intermediate layer of cells 24 of left outer column 17 and right outer column 20. As the first intermediate layer of cells 24 fully inflates, each subsequent layer follows the same sequence. Uppermost layer of cells 26 is the last layer to inflate.

At this point, the cells of uppermost layer of cells 26 will be finished inflating, as seen in FIGS. 7 and 8, and the user will be able to move to a standing position.

According to some embodiments of the present, invention, the inflation rate may be further controlled by modifying the size of vertical air holes 30 and horizontal air holes 48. For example, there may be smaller vertical air holes 30 on the surfaces between left outer column 17 and an inner column 18 and between right outer column 20 and an inner column 18 in order to inflate all of the cells of a particular layer at same time, while still maintaining a slower inflation rate of the cells of left outer column 17 and right outer column 20.

According to some embodiments of the present invention, by inflating cushion 10 according to a predefined air flow, the cells of inner columns 18 inflate at a slower rate than the cells of left outer column 17 and right outer column 20, providing lateral stability for the user.

According to some embodiments of the present invention, the air may flow from left outer column 17 and right outer column 20 into inner columns 18.

The plurality of inflatable cells that comprise cushion 10 may be constructed of any type of material that is flexible, thin, lightweight, and air-sealable. Any material that includes these properties may be suitable for the present invention, including, inter alia, plastic-coated fabrics. In some embodiments, the materials used to construct the inner and outer surfaces are the same, while in other embodiments the inner and outer surfaces may be constructed of dissimilar materials. It is understood that other materials may be used without departing from the scope of the invention.

Base layer 16 may be connected to lowermost layer of cells 22 of cushion 10 along the edges of base layer 16 and at horizontal air holes 48 located between base layer 16 and lowermost layer of cells 22 of cushion 10. The cells comprising columns 17, 18, and 20 may be connected, for example, along their shared edges and at shared horizontal air holes 48 and vertical air holes 30. The various components of the present invention may be connected together by one or more methods, including, inter alia, sewing, gluing, ultrasonic welding, and radio wave welding. Other connection methods and configurations may also be used without departing from the scope of the invention.

According to some embodiments, some or all of the cells comprising the present invention may be substantially wedge-shaped. According to some other embodiments, some or all of the cells may be of the substantially polygonal shape. In yet other embodiments, the cells may be constructed in yet other shapes without departing from the scope of the invention.

In order to more fully describe the present invention, the following describes a mode of use.

Entire cushion 10 may be folded to fit into a small carry case that may also accommodate portable air pressure generator 54. When needed for use, cushion 10 may be unfolded and placed on a chair 50. Hose 56 of air pressure generator 54 may then be attached to cushion 10. Air pressure generator 54 may be placed, for example, on the floor as shown in FIG. 1, or, alternatively, suspended over the back of a chair 50. Once cushion 10 is in place and air pressure generator 54 has been attached, cushion 10 is ready to be inflated and the user may sit on in the chair 50.

By activating air pressure generator 54, cushion 10 may be inflated. Air travels from air pressure generator 54 through hose 56 into base layer 16. The cells of cushion 10 are then filled sequentially with air, according to the airflow sequence described above. As cushion 10 fills with air, cushion 10 lifts the user. The overall shape of cushion 10 and the sequential inflation of each cell of cushion 10 ensure that the user remains comfortably in a seated position on seating surface 52 while cushion 10 is inflating.

Once cushion 10 is fully inflated, cushion 10 will have lifted the user sufficiently that the user need only angle himself forward in order to exit chair 50. The user may also remain comfortably seated on seating surface 52 of cushion 10 after cushion 10 has been inflated.

After the user has exited chair 50, cushion 10 may be deflated by means of the deflate valve, or by using air pressure generator 54, or by disconnecting hose 56 and allowing the air to escape through the opening. Once deflated, cushion 10 may again be folded and inserted into a small carry case.

While cushion 10 of the present invention, as described herein, is primarily intended for use in assisting the user to rise from a seated position, cushion 10 may also assist the user in sitting wherein, by controlling the rate of deflation, cushion 10 may gradually lower the user to a seated position.

Because of the portable nature of the present invention, cushion 10 is also well suited for use in, for example, shower stalls equipped with seating areas, thus further enabling the independence of the user.

While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A portable cushion divided into multiple inner cells, said cushion comprising:

at least two columns, each of at least two inflatable cells such as to form at least two respective layers, a lightweight, portable air pressure generator for supplying air to the cushion, a hose to connect said cushion to said air pressure generator, at least one air hole being disposed vertically between two contiguous cells of a layer, and at least one air hole being disposed horizontally between two contiguous cells of a column for fully inflating one cell of said column before an upper subsequent cell of said column being inflated.

2. The device of claim 1 that forms a substantially polygon-shaped, cushion when fully inflated.

3. The device of claim 1, wherein at least one column is connected to a base layer by at least one air hole disposed horizontally between the upper surface of the base layer and the bottom surface of the lowermost cell of the column.

4. The device of claim 1, wherein each cell is connected with at least one contiguous cell by at least one air hole.

5. The device of claim 1, wherein at least one air hole is disposed horizontally between each of the cells comprising a column.

6. The device of claim 1, wherein at least one horizontally disposed air hole is equipped with an air pressure controlled valve.

7. The device of claim 1, wherein at least one vertically disposed air hole is equipped with an air pressure controlled valve.

8. The device of claim 1, wherein each cell will start to inflate after the cell beneath it has finished inflating.

9. The device of claim 1, wherein each layer of cells will start to inflate after the layer of cells beneath it has finished inflating.

10. The device of claim 1, that further provides a substantially planar seating surface for the user throughout the inflating process.

11. The device of claim 1, that is adapted to fit the shape of the seat of a specific chair.

12. The device of claim 1, wherein at least one air hole is equipped with a controlled valve.

* * * * *